United States Patent [19]

De Woskin

[11] 4,314,415

[45] Feb. 9, 1982

[54] IDENTIFICATION BANDS AND METHODS OF AND APPARATUS FOR MAKING THEM

[75] Inventor: Kenneth J. De Woskin, University City, Mo.

[73] Assignee: Beltx Corporation, Barnhart, Mo.

[21] Appl. No.: 82,953

[22] Filed: Oct. 9, 1979

[51] Int. Cl.[3] ..... G09F 3/14

[52] U.S. Cl. ..... 40/21 C

[58] Field of Search ..... 40/21, 21 C, 2 R; 24/16 PB, 17 AP

[56] References Cited

U.S. PATENT DOCUMENTS

| | | | |
|---|---|---|---|
| 2,561,894 | 1/1951 | Wallich | 40/21 C |
| 2,648,924 | 8/1953 | Brewster | 40/2 R |
| 2,954,620 | 10/1960 | Schneider | 40/21 C |
| 3,027,665 | 4/1962 | St. John | 40/21 C |
| 3,153,869 | 10/1964 | Twentier | 40/21 C |
| 3,197,899 | 8/1965 | Twentier | 40/21 C |
| 4,078,324 | 3/1978 | Wiebe | 40/21 C |

*Primary Examiner*—Hugh R. Chamblee
*Assistant Examiner*—Wenceslao J. Contreras
*Attorney, Agent, or Firm*—Senniger, Powers, Leavitt and Roedel

[57] ABSTRACT

Identification bands, particularly for use in hospitals as identification bracelets and other patient related labeling requirements, made up of a number of tapes laminated together by pressure-sensitive adhesive, including a transparent tape as an outer tape, with an insert underlying the transparent tape and have preprinted identification indicia on its face facing the transparent tape, at least one of the tapes being a pressure-sensitive tape having pressure-sensitive adhesive on one surface thereof, part of which is at an end of the band adapted to be exposed, with release means covering the pressure-sensitive adhesive at said end, and methods of and apparatus for making the bands.

20 Claims, 15 Drawing Figures

IDENTIFICATION BANDS AND METHODS OF AND APPARATUS FOR MAKING THEM

BACKGROUND OF THE INVENTION

This invention relates to identification bands, and more particularly to disposable identification bands which may be formed into identification bracelets for patients in hospitals or similar institutions.

While it is contemplated that the invention is applicable to bands for general labelling, it especially involves an improvement over prior disposable identification bracelets for hospital patients adapted to display identifying indicia and to prevent unauthorized tampering with the indicia (tampering may result in irreparable visible damage to the bracelet). Prior bracelets may be of a first type such as shown for example in U.S. Pat. Nos. 3,197,899 and 4,078,324 comprising a plurality of laminated strips, one of which is a pressure-sensitive record material such as strip 24 of the bracelet of U.S. Pat. No. 4,078,324 or has a portion for receiving indicia thereon such as area 18 of the bracelet of U.S. Pat. No. 3,197,899. A problem with bracelets of this type has been that printing the indicia on the strip by means of office printing equipment, in particular computer printers, is difficult and time-consuming. Prior bracelets may also be of a second type such as shown for example in U.S. Pat. Nos. 2,954,620 and 3,027,665 comprising a tubular band adapted to be opened to receive an insert such as a slip of paper with indicia printed thereon, and to be closed by fastening means at each end of the band. A problem with bracelets of this second type has been that they require the use of a tool to secure the fasteners together, which use is inconvenient to hospital personnel. Some rely on metal fasteners which are uncomfortable and abrade the wearer's skin. In addition, the insert may not be completely sealed by the band and thus, may become wet and thereby obliterated.

SUMMARY OF THE INVENTION

Among the several objects of this invention may be noted the provision of an identification band of the class described having an indicia-bearing insert therein, the band being such as to enable ready utilization of an insert with identification indicia printed thereon by office printing equipment such as a computer printer; the provision of such a band which completely and permanently seals the insert between strips of the band to protect it from tampering and from being wetted; the provision of such a band which may be formed into a bracelet and readily attached to a patient without the use of any tools; the provision of such a band which conveniently utilizes pressure-sensitive adhesive tape as one of its strips; and the provision of such a band which is of simple, economical construction.

In general, an identification band of this invention comprises a plurality of strips laminated together by pressure-sensitive adhesive, one of the strips constituting an outer strip, and an insert underlying the outer strip having indicia on one face thereof facing the outer strip, the outer strip being transparent at least in part for visibility of the indicia on the insert. One of the strips constitutes an inner strip terminating short of the adjacent strip at least in part at one end of the band, the adjacent strip having pressure-sensitive adhesive on one surface thereof constituting an inwardly facing surface and being laminated to said inner strip by means of the pressure sensitive adhesive. The pressure-sensitive adhesive extends throughout the length of the adjacent strip, whereby the adjacent strip has an inwardly facing surface portion having pressure-sensitive adhesive thereon exposed beyond the first strip at said one end of the band. Release means covers the pressure-sensitive adhesive on said portion of the adjacent strip.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
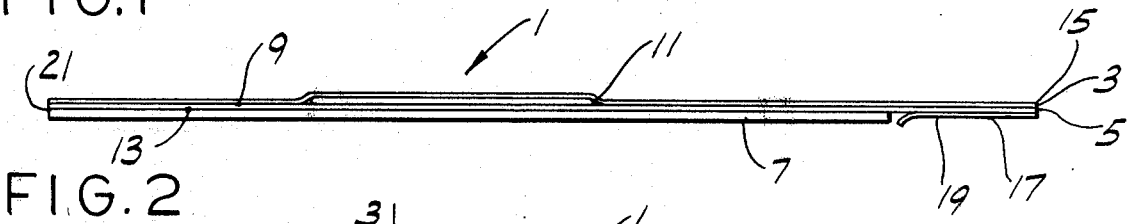
FIG. 1 is a side edge elevation of a first embodiment of the identification band of this invention.
Figure 2:
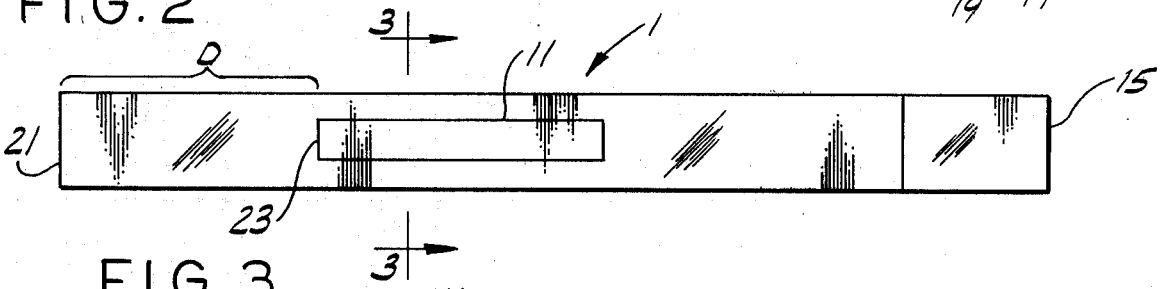
FIG. 2 is a top plan of the band of FIG. 1.
Figure 3:
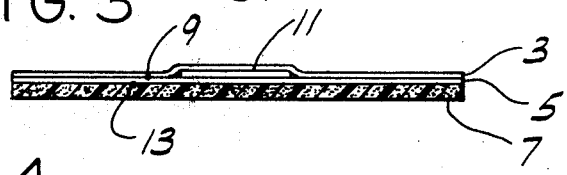
FIG. 3 is a transverse section of the band on line 3—3 of FIG. 2.

Refering to FIGS. 1–3 there is generally indicated at 1 an identification band constituting a first embodiment of this invention comprising first, second and third tapes 3,5 and 7, the second being sandwiched between the first and the third, the first being transparent, the third being of cushioning material. The first and second tapes are laminated together by pressure-sensitive adhesive 9 with an insert 11 therebetween having pre-printed identification indicia on one face thereof facing the first tape. The second tape extends the full length of the first tape and has pressure-sensitive adhesive 13 on its surface opposite the first tape, the second and third tapes being laminated together by the layer of pressure-sensitive adhesive 13. The third tape terminates short of the second tape at an end 15 of the band, the second tape thereby having a portion 17 at the end 15 of the band extending beyond said third tape having the pressure-sensitive adhesive thereon. A release member 19 is provided covering the pressure-sensitive adhesive on the portion of the second tape.

The first tape is a strip of suitable transparent material, and the layer of pressure-sensitive adhesive 9 thereon is a suitable pressure-sensitive adhesive material such as an acrylate pressure-sensitive adhesive. The first tape may be approximately one inch wide and nine to ten inches in length, which length is sufficient to enable the tape to be formed into a bracelet encircling the wrist of most patients. While the layer of adhesive 9 is shown on the first tape, it is possible that the layer of adhesive may be on the side of the second tape 5 toward the first.

The second tape is a strip of suitable polyester material, and the layer of pressure-sensitive adhesive 13 thereon may be a synthetic rubber based adhesive such as styrene-butadiene rubber (SBR) compounded with a suitable tackifying agent such as a polyterpene resins or oil-soluble phenolic resins.

The third tape 7 is a strip of a soft, nonwoven preferably opaque cushioning material such as cross-linked polyethylene foam material commercially available under the trade name "Volara." The release means 19 comprises a paper (or the like) release member releasably adhered to the pressure-sensitive adhesive on the portion 17 of the second tape, the pressure-sensitive adhesive being exposed upon removing the release member for adherence of the second tape 5 at its end 15, to the first tape 3 at the other end 21 of the band to form a bracelet. The second and third tapes 3, 5 and the release member together constitute a band length of a composite strip 22 (see FIG. 14) for use in the method of making the first embodiment of the identification band as described more fully hereinafter.

The insert 11 is of a material capable of having identification indicia printed thereon. Preferably, it is a slip of paper upon which identification indicia has been preprinted by office equipment such as a typewriter or a computer printer. The insert is shorter and narrower than the first and second tapes 3 and 5 and is disposed between the tapes with its surface having indicia thereon facing the first tape and with its edges spaced inwardly from the edges of the first and second tapes so as to be completely sealed between the tapes to prevent exposure of the insert to moisture. To prevent the possibility of overlapping a portion of the insert 11 with a portion of the opaque third tape 13 thus obscuring the indicia on the insert when the band is formed into a bracelet encircling a patient's wrist, the end 21 of the band and the adjacent end 23 of the insert are spaced apart a suitable distance D (e.g., a distance of two or three inches).

Figure 4:
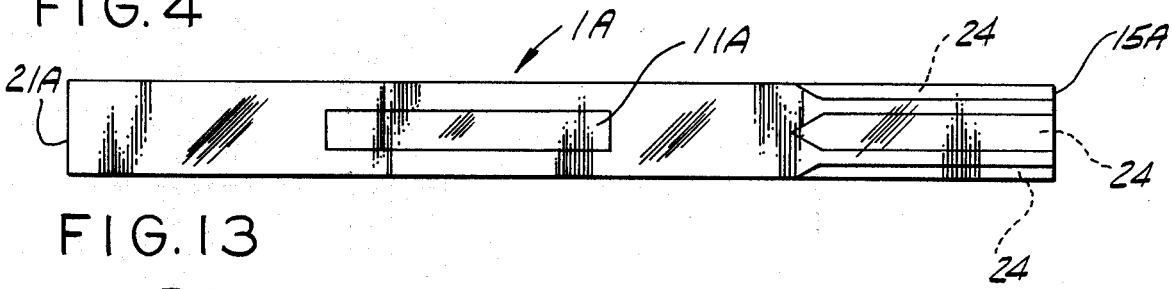
FIG. 4 is a top plan of a second embodiment constituting a modification of the band of FIGS. 1—3.

FIG. 4 illustrates a second embodiment of the identification band generally indicated at 1A which is similar to the first embodiment except that it does not include a release member and its third strip 7 has cutouts 24 at the end 17A of the band for exposing areas of the pressure-sensitive adhesive on the second tape.

Figure 5:
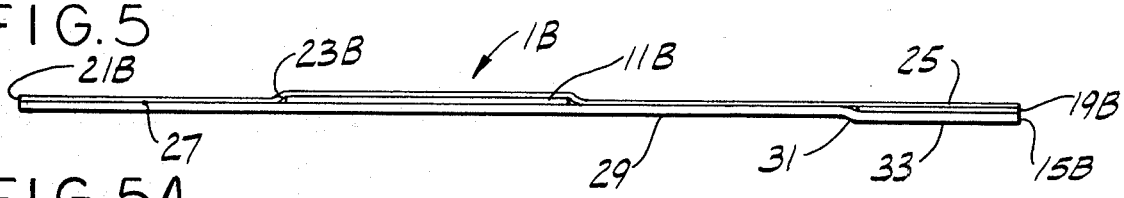
FIG. 5 is a side edge elevation of a third embodiment of the identification band of this invention.
Figure 5A:
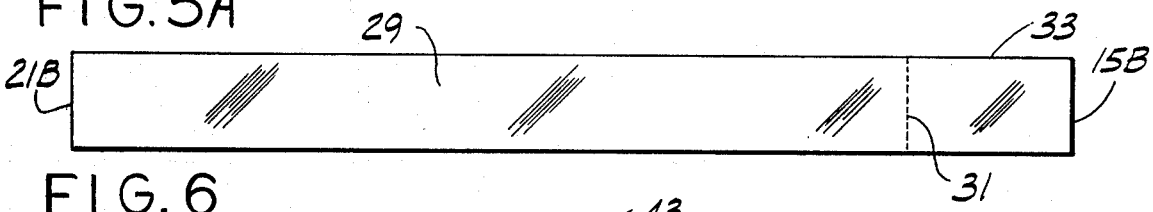
FIG. 5A is a bottom plan of FIG. 5.
Figure 9:
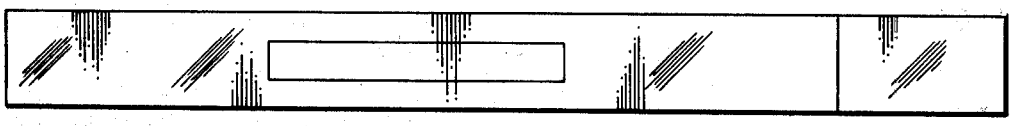
FIG. 9 is a top plan of either the third or fourth embodiments of the identification band.

FIGS. 5, 5A and 9 illustrate a third embodiment of the identification band of this invention generally indicated at 1B comprising a transparent tape 25 having pressure-sensitive adhesive 27 on one surface thereof constituting its inside surface, a second tape 29 extending the full length of the transparent tape and having a transverse line of perforations 31 adjacent one end 15B thereof defining an end portion 33 of the second tape adapted to be torn away from the remainder of the second tape. The second tape is laminated to the transparent tape by the pressure-sensitive adhesive 27 on the inside surface of the transparent tape from the other end 21B of the band to the line of perforations 31. An insert 11B is provided between the transparent tape and the second tape, the insert being located between the end 21B of the band and the line of perforations and having pre-printed identification indicia thereon on one face thereof facing the transparent tape. Release means 19B is provided between the end portion 33 of the second tape and the transparent tape over the pressure-sensitive adhesive on the inside surface of the transparent tape at the end 15B of the band.

The release means may comprise a coating of a release agent on the inside surface of the end portion 33 of the second tape or, alternatively, it may comprise a paper (or the like) release member adhered to the inside surface of the end portion of the second tape. The pressure-sensitive adhesive 27 on the inside surface of the transparent tape at the end 15B of the band is exposed upon removing the end portion 33 and the release means thereon from the remainder of the second tape.

The transparent tape 25, like the second tape 5 of the first embodiment, is a strip of suitable polyester material. The layer of pressure-sensitive adhesive 27, like the pressure-sensitive adhesive 13 of the first embodiment, is of sytrene-butadiene rubber compounded with suitable tackifying agent, and the second tape 29, like the third tape of the first embodiment, is of polyethylene foam material.

Figure 8:
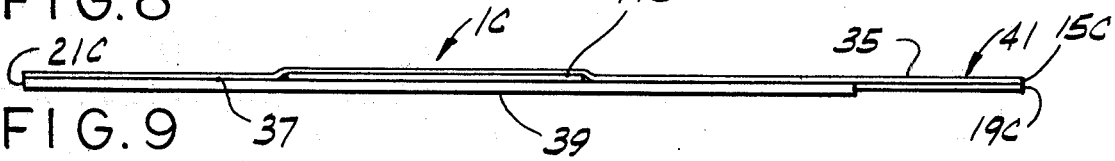
FIG. 8 is a side edge elevation of the fourth embodiment of the identification band showing an insert therein.

FIGS. 8 and 9 illustrate a fourth embodiment of a completed identification band of this invention generally indicated at 1C comprising a transparent tape 35 having pressure-sensitive adhesive 37 on one surface thereof constituting its inside surface, and a second tape 39 extending lengthwise of the transparent tape laminated to the transparent tape by the pressure-sensitive adhesive on the inside surface of the transparent tape. The second tape terminates short of one end 15C of the band, the transparent tape thereby having a portion 41 extending beyond the second tape. An insert 11C is provided between the transparent tape and the second tape, the insert having pre-printed identification indicia on one face thereof facing the transparent tape. Release means 19C covers the pressure-sensitive adhesive on the inside surface of the portion 41 of the transparent tape extending beyond the second tape.

The transparent tape 35, the layer of pressure-sensitive adhesive 37 thereon, and the second tape 39 are of the same materials as the transparent tape 25, the pressure-sensitive adhesive 27 and the second tape 29 of the third embodiment 1B of the band, respectively. It will be observed that the third and fourth embodiments of the identification band of this invention appear the same in top plan and thus either of these embodiments may be illustrated in FIG. 9.

Figure 6:
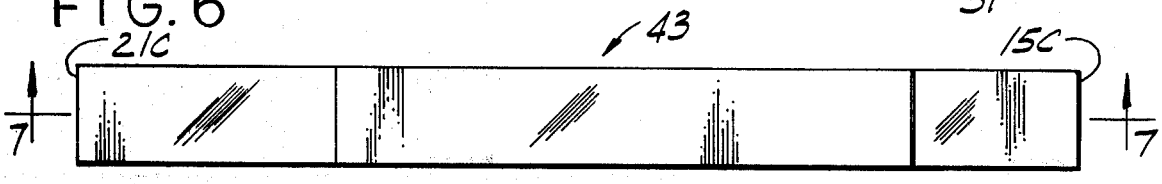
FIG. 6 is a top plan of a band for use in making a fourth embodiment of the identification band of this invention.
Figure 7:
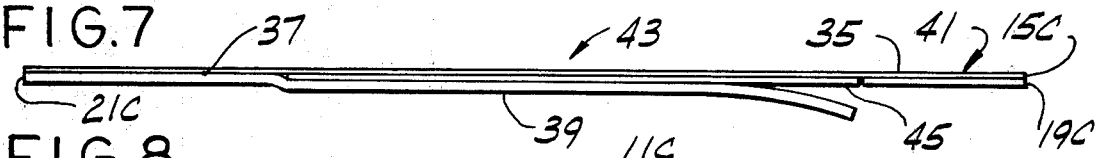
FIG. 7 is a side edge elevation of the FIG. 6 band.

FIGS. 6 and 7 illustrate a band 43 for receiving an insert such as the insert 11C having pre-printed identification indicia on one face thereof to form the fourth embodiment of the identification band 1C of this invention, the band 43 comprising a transparent tape such as the tape 35 having pressure-sensitive adhesive such as the adhesive 37 on one surface thereof constituting its inside surface. Release means covers the pressure-sensitive adhesive on the inside surface of the transparent tape and extends lengthwise of the transparent tape from the end 15C of the transparent tape toward and terminating short of its other end 21C. A second tape such as the tape 39 extends lengthwise of the transparent tape from the end 21C of the tape toward the terminating short of the end 15C of the transparent tape, the second tape being adhered to the transparent tape between the end 21C of the transparent tape and the release means. The release means is removable to expose the pressure-sensitive adhesive on the inside surface of the transparent tape for placement of an insert having preprinted indentification indicia on one face thereof between the tapes with the one face of the insert facing the transparent tape and for adherence of the tapes, with a portion 41 of the transparent tape extending beyond the second tape at the end 15C of the transparent tape and having the pressure-sensitive adhesive 37 thereon on its inside surface for adherence to the transparent tape at its other end 21C to form a bracelet. The release means comprises a first paper (or the like) release member 45 having its ends spaced inwardly from the ends of the band and a second paper (or the like) release member such as the release means 19C extending between the end 15C of the band and the adjacent end of the first release member 45.

In use, the band 43 of FIGS. 6 and 7 is formed into the fourth embodiment 1C of the identification band illustrated in FIGS. 8 and 9 by separating the portion of the second tape 39 overlapping the first release member 45 away from the first transparent tape 35, (i.e., peeling back the free end of the second strip 39), removing the first release member 45 from the transparent tape to expose the layer of pressure-sensitive adhesive 37, placing the insert on the first tape 35 with its face having the pre-printed identification indicia thereon facing the transparent tape, covering the exposed layer of pressure-sensitive adhesive with the second tape, and pressing the tapes together to laminate the second tape to the transparent tape by the pressure-sensitive adhesive and to seal the insert therebetween.

It will be observed that each of the first, third and fourth embodiments of the identification band comprises a plurality of strips laminated together by pressure-sensitive adhesive, one of the strips constituting an outer strip (i.e., tape 3, 25 and 35 of the first, third and fourth embodiments, respectively), and an insert (11, 11B and 11C) underlying the outer strip having preprinted identification indicia on one face thereof facing the outer strip. The outer strip being transparent at least in part for visibility of the indicia on the insert. One of the strips constitutes an inner strip (i.e., tape 7, 29 and 39 of the first, third and fourth embodiments, respectively), the inner strip terminating short of the adjacent strip (i.e., tape 5, 25 and 35 of the first, third and fourth embodiments, respectively) at least in part at one end of the band, the adjacent strip having pressure-sensitive adhesive on one surface thereof constituting an inwardly facing surface by means of which it is laminated to said inner strip. The pressure-sensitive adhesive extends throughout the length of the adjacent strip, whereby the adjacent strip has an inwardly facing surface portion having pressure-sensitive adhesive thereon exposed beyond said inner strip at said one end of the band. Release means (19, 19B, 19C) is provided over the pressure-sensitive adhesive on said portion.

Figure 13:
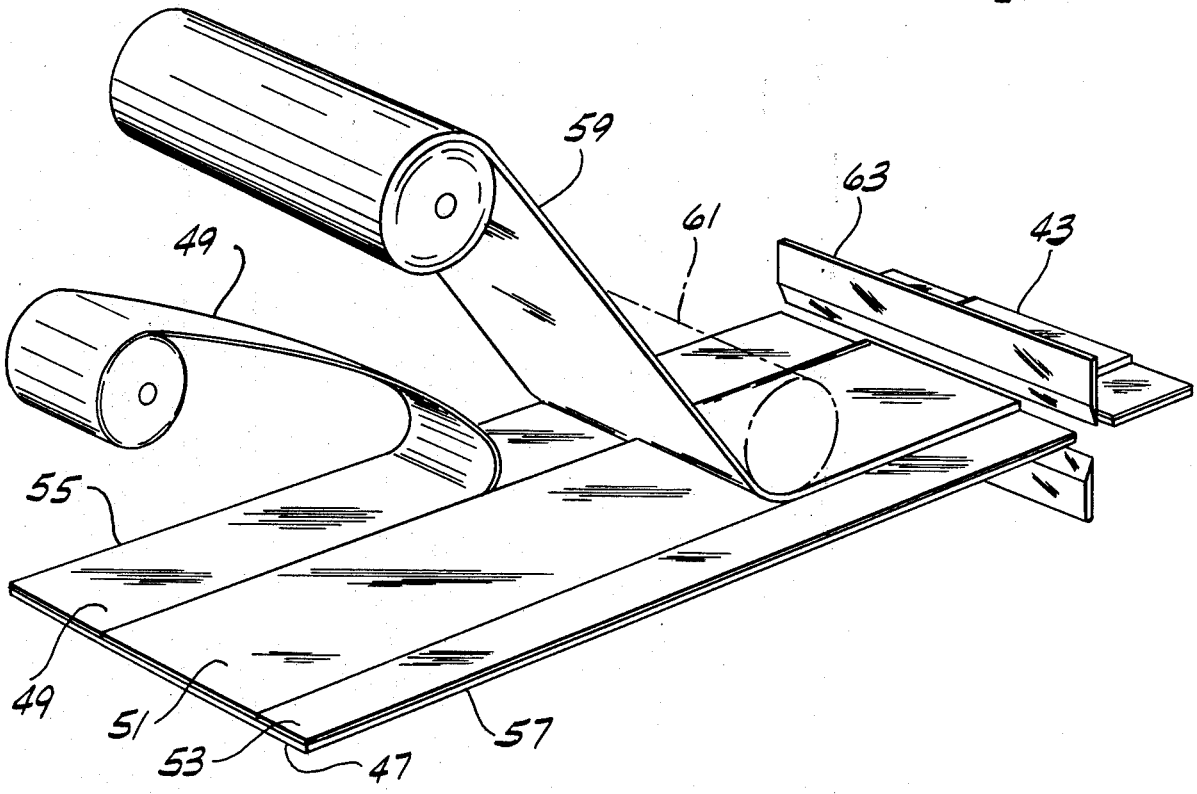
FIG. 13 is a schematic of apparatus for making the band of FIGS. 6 and 7.

FIG. 13 illustrates in schematic form a method for making bands of this invention, such as bands 43, for use in making identification bracelets. In this method, a first web 47 having a width corresponding to the length of the bands to be made is provided, the web comprising transparent film having pressure-sensitive adhesive on one surface thereof with first, second and third release strips 49, 51 and 53 extending lengthwise of the first web on the pressure-sensitive adhesive, the first release strip 49 extending adjacent one side edge 55 of the first web, the third extending adjacent the other side edge 57 of the first web, and the second extending between the first and third release strips. The first web is fed forward and, as it is so fed, the first release strip 49 is peeled off the web to expose the pressure-sensitive adhesive adjacent the edge 55. The first web is then combined with a second web 59 of cushioning material (e.g., polyethylene foam material) at a combining roll 61, the second web having a width generally corresponding to the spacing between the edge 55 of the first web and the inner edge of the third strip 53 and being combined with the first web with one edge of the second web generally aligned with the edge 55 of the first web and with the second web adhered to the film by the exposed pressure-sensitive adhesive, lapping over the second release strip 51 and having its other edge generally aligned with the inner edge of the third strip. The combined first web, second and third release strips and second web are severed transversely by cutting means 63 into bands 43.

Figure 14:
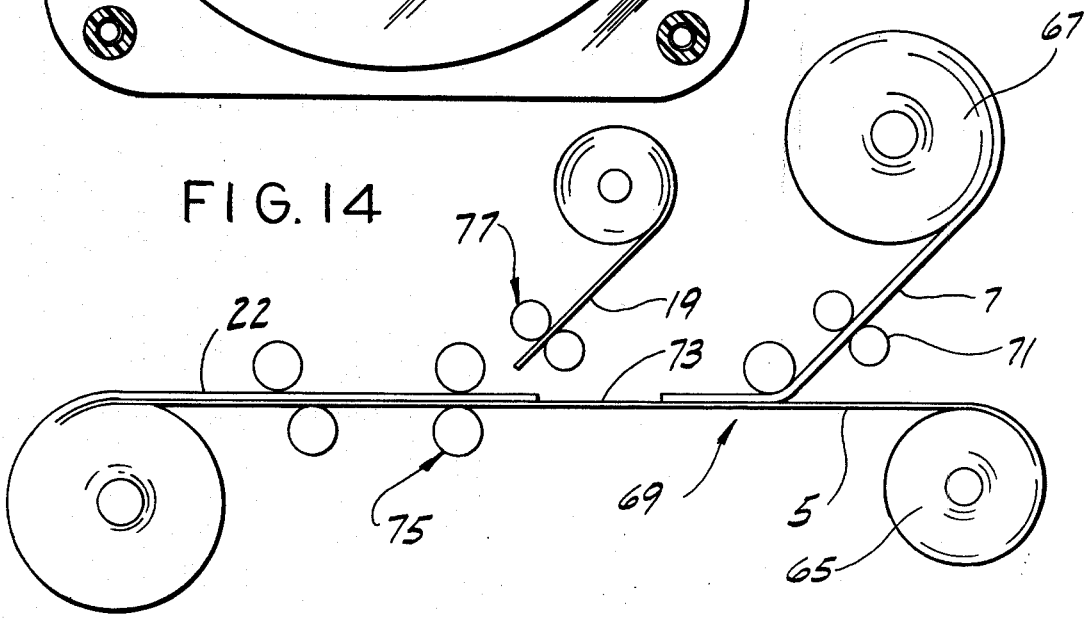
FIG. 14 is a schematic of apparatus for making a composite strip for use in making the first embodiment of the identification band.

FIG. 14 illustrates in schematic form a method of making the composite strip 22 for use in making the first embodiment 1 of the identification band of this invention. In this method, a continuous transparent tape 5 having pressure-sensitive adhesive on a surface thereof and a continuous tape 7 of cushioning material are fed forward from respective supplies thereof 65, 67 toward a first laminating zone 69, the transparent tape being fed forward as a continuous strip, the tape of cushioning material being fed forward in a series of predetermined relatively short lengths in timed relation to the transparent tape by conventional feeding and cutting means 71 so as to form gaps 73 at equal intervals along the transparent tape. The tape cushioning material and the transparent tape are pressed together as they are fed through the laminating zone to laminate the tapes together. The laminated-together tapes and release means 19 are fed forward to a second laminating zone 75, the laminated-together tapes being fed as a continuous composite strip, the release means being fed in a series of release members of predetermined length in timed relation to the laminated-together tapes by conventional feeding and cutting means 77 so as to cover the pressure-sensitive adhesive on the surface of the transparent tape in the gaps 73. The release members and the tapes are pressed together as they are fed through the second laminating zone 75 to releasably adhere the release members (e.g., paper or the like) to the pressure-sensitive adhesive on the transparent tape in the gaps 73.

In the method of making the first and third embodiments of the identification bands of this invention, band lengths of a first strip, (i.e., the transparent tape 3, 25 of the first or third embodiments) and a second strip (i.e., the composite strip 22 for the first embodiment or the second tape 29 of the third embodiment) for forming the band are fed forward from respective supplies of the strips, the strips being fed forward through a strip laminating zone in longitudinal alignment and spaced relation. One of the strips has pressure-sensitive adhesive on one face thereof facing the other strip. An insert 11, 11B having pre-printed identification indicia on one face thereof is entered into position between the strips as they enter the zone with said one face of the insert facing the first strip, the insert being entered between the edges of the strips with its leading end rearward of the leading end of the strips. The strips are pressed together as they travel through said zone to cause the strips to become laminated together by the pressure-sensitive adhesive with the insert sealed therebetween.

The laminated-together strips are then severed in band lengths from the remainder of the strips.

In the method of forming the first embodiment of the identification band, the composite strip 22 constituting the second strip comprises a continuous length of the transparent tape 5 and a continuous length of the third tape 7, and release means 19 on one surface of the second tape. The first and second strips are brought together at the laminating zone with the pressure-sensitive adhesive on the surface of the first strip toward the other surface of the second strip and with release means on the outside of the second strip.

In the method of forming the third embodiment (FIG. 5) of the identification band, the second strip comprises the tape 29 of cushioning material having transverse lines of perforations 31 spaced at intervals corresponding to the length of the bands to be made, and release means 19B spaced at band length intervals and located adjacent the lines of perforations. The first and second strips are brought together as they enter the laminating zone with the pressure-sensitive adhesive on the inside surface of the first strip toward one surface of the second strip.

Figure 11:
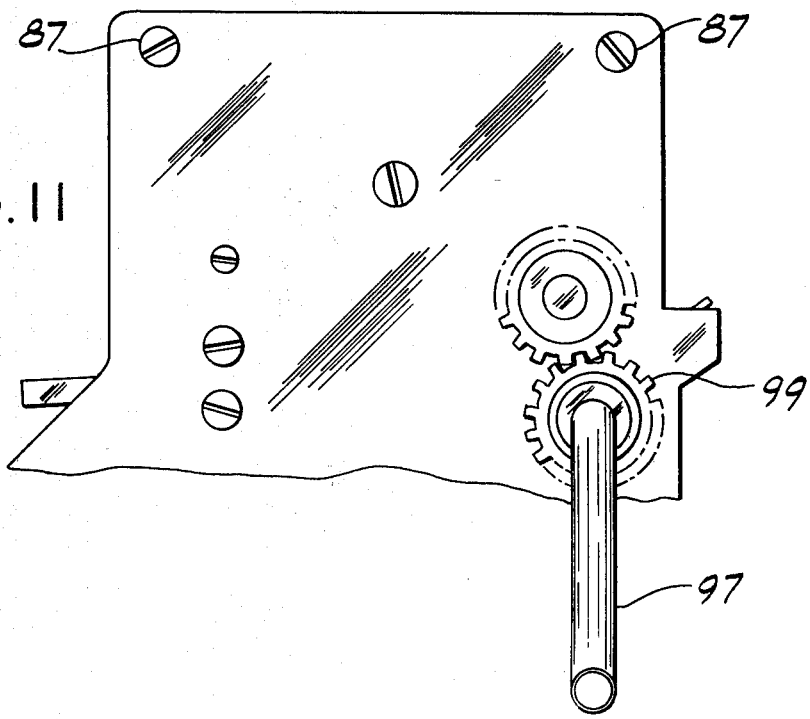
FIG. 11 is a partial side elevation of the apparatus of FIG. 10.
Figure 10:
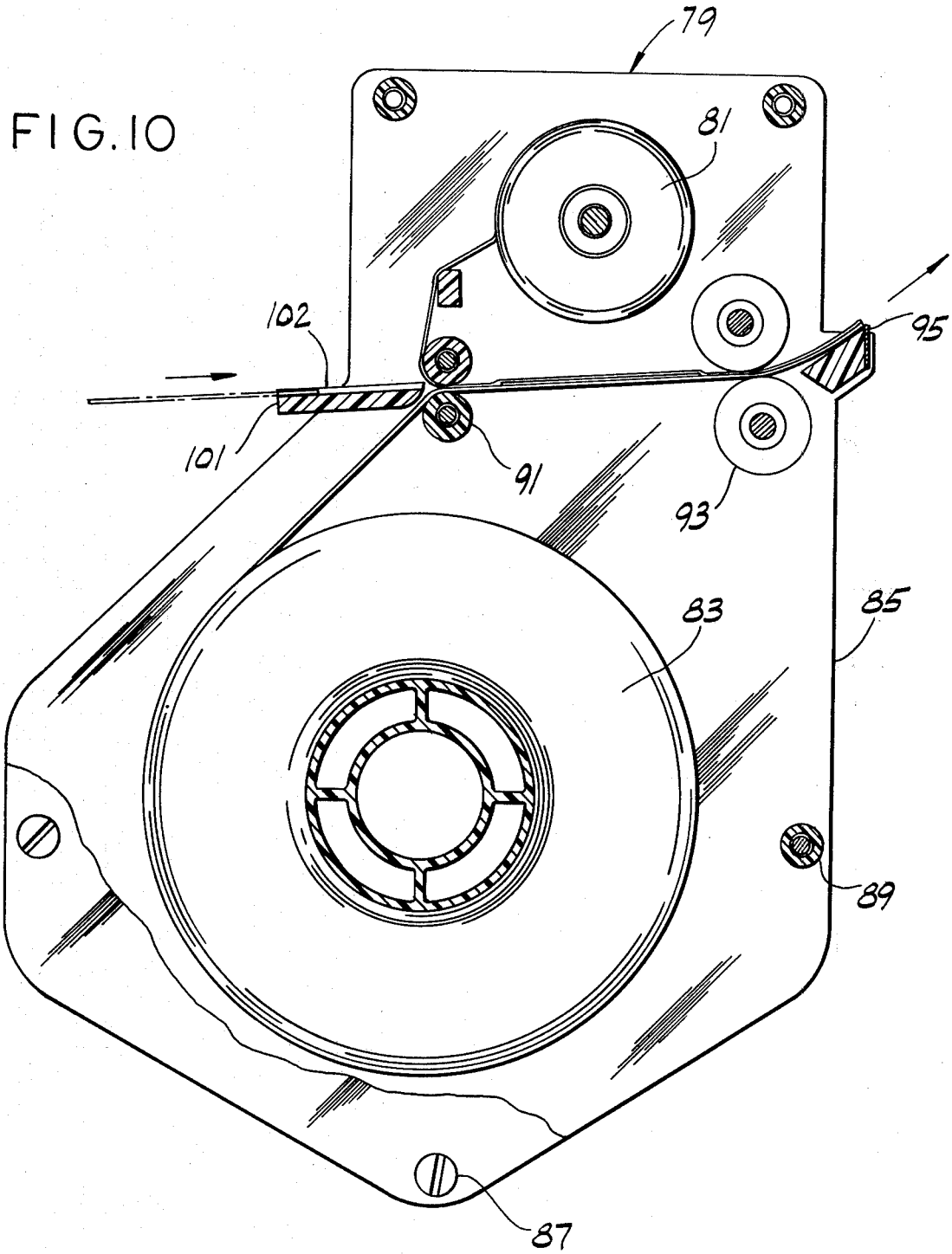
FIG. 10 is a partial central section of apparatus for making identification bands of this invention.

FIGS. 10 and 11 illustrate apparatus generally indicated at 79 for making the first and third embodiments of the identification band of this invention. The apparatus comprises means for holding a roll 81 of the first strip (i.e., a continuous length of the transparent tape 3, 25 of the first or third embodiments) and means for holding a roll 83 of the second strip (i.e., composite strip 22 or a continuous length of the second strip 29 of the first and third embodiments, respectively). The rolls are rotatably mounted on a support 85 comprising two side walls secured together by conventional fastening means 87 with spacers 89 holding the walls spaced apart a predetermined distance. The apparatus further comprises a first pair of rolls 91 rotatably mounted on the support between which the strips are fed forward together, a second pair of rolls 93 rotatably mounted on the support forward of the first pair between which the strips are fed forward and pressed together, and severance means such as a cutter blade 95 forward of the second pair of rolls. The apparatus 79 further comprises means for driving the second pair of rolls, such as the handle 97 and gears 99 on the rolls of the second pair to draw the strips through the first pair of rolls and feed them forward past the serverance means a distance corresponding to the length of the band 1, 1B. The strips travel toward the first pair of rolls in longitudinal alignment and in spaced relation. Means, such as plate 101 having a groove 102 in the upper surface thereof, extends toward the nip of the first pair of rolls 91 for guiding the insert 11, 11B into position between the strips in the nip, the insert being shorter than the band length and narrower than the strips and guided to enter between the edges of the strips. One of the strips has the release means 19, 19B spaced at band length intervals covering pressure-sensitive adhesive thereon, the release means being at the ends of band lengths of the laminated-together strips and each being removable from the band in which it is ultimately included for exposing pressure-sensitive adhesive at one end of the band for adherence to the other end to form a bracelet. The second pair of rolls 93 is operable to feed a band length of the laminated-together strips forward past the cutter blade 95, the band length being adapted to be severed from the remainder of the strips at the cutter blade, each severed band having a release means at said one end. The distance from the nip of the first pair of rolls 91 to the cutter blade 95 along the path of movement of the strips corresponds to the distance D between the end 23, 23B of the insert and the end 21, 21B of the band (see FIG. 2). Thus, if the end 23, 23B of the insert is entered in the nip of the first set of rolls when the end 21, 21B of the band length is at the cutter blade, the identification band formed in the apparatus may be formed into a bracelet around a patient's wrist without obscuring the identification indicia on the insert.

Figure 12:
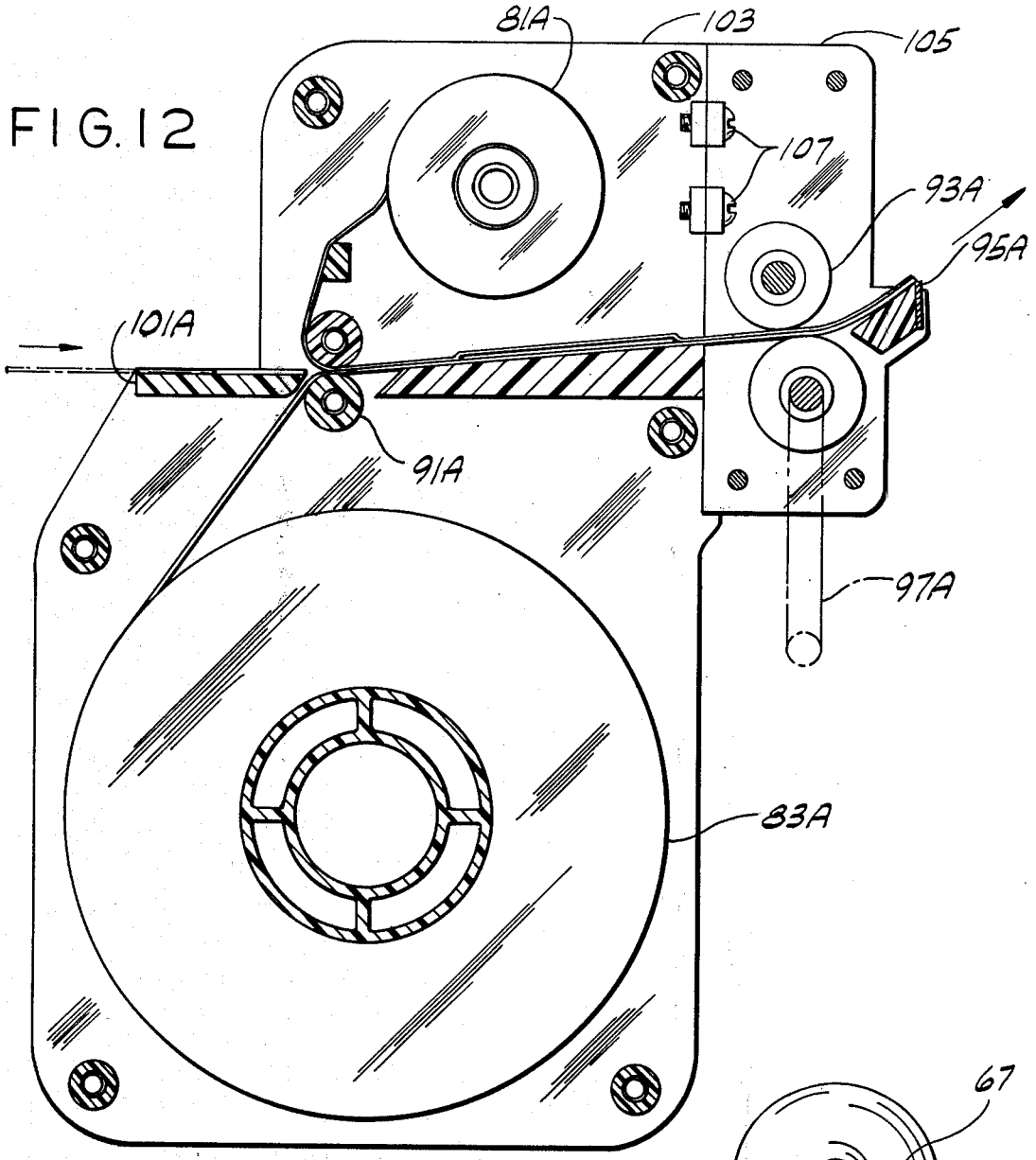
FIG. 12 is a section of a modification of the apparatus.

FIG. 12 illustrates a modification of the above-described apparatus in which the support 85 comprises first and second sections 103 and 105 releasably secured together by conventional fastening means as indicated at 107. The means 81A for holding a roll of the first strip, the means for holding a roll of the second strip 83A, the first pair of rolls 91A and the guide plate 101A are mounted on the first section 103. The second pair of rolls 93A and the cutter blade 95A are mounted on the second section. In the use of this modified apparatus, with the first and second sections separated, the ends of the first and second strips which have been previously brought together by the first pair of rolls 93A in the first section are placed at the nip of the second pair of rolls 95A and fed therethrough by operating the drive means 97A. Thereafter, the sections 103 and 105 are releasably secured together. The apparatus is then ready to dispense band lengths of the laminated-together strips until the rolls of the strips are exhausted. When this occurs, the first section may be removed from the second section and another section similar to the first section but having fresh rolls of the strips thereon may then be secured to the second section.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An identification band comprising a plurality of strips laminated together by pressure-sensitive adhesive, one of the strips constituting an outer strip, an insert underlying the outer strip having pre-printed identification indicia on one face thereof facing the outer strip, the outer strip being transparent at least in part for visibility of the indicia on the insert, one of the strips constituting an inner strip having an exposed face engageable with a wearer of the band, when the band is worn, and extending lengthwise of the adjacent strip but terminating short of the adjacent strip at least in part at one end of the band, said adjacent strip having pressure-sensitive adhesive on one surface thereof constituting an inwardly facing surface by means of which it is laminated to said inner strip, said pressure-sensitive adhesive extending throughout the length of said adjacent strip, said adjacent strip having an inwardly facing surface portion having pressure-sensitive adhesive thereon exposed beyond said inner strip at said one end of the band, said band having release means over the pressure-sensitive adhesive on said portion, whereby, upon removing the release means, the band may be formed into a bracelet with said adjacent strip at said end portion adhered to the outer strip adjacent the other end of the band.

2. An identification band as set forth in claim 1 wherein the said inner strip comprises cushioning material.

3. An identification band as set forth in claim 1 comprising three layers of tape, the first constituting the said outer strip and being transparent, the second constituting the said adjacent strip and the third constituting the said inner strip, the second being of the same length as the first, the third being formed for exposure of the pressure-sensitive adhesive on said portion of the second.

4. An identification band as set forth in claim 3 wherein the third tape terminates wholly short of the second tape at said one end of the band to provide said portion, and said release means constitutes a release member removably adhered to said portion.

5. An identification band as set forth in claim 4 wherein said third tape comprises cushioning material.

6. An identification band as set forth in claim 1 comprising two layers of tape, the first constituting the said outer strip and also being the said adjacent strip, said first tape being transparent, said tapes being laminated together by pressure-sensitive adhesive on the inside face of the first tape, the second tape terminating short of the first tape at one end of the band thereby enabling exposure of pressure-sensitive adhesive on the inside face of the first tape at said one end of the band, said release means covering said pressure-sensitive adhesive on said inside face of the first tape at said one end of the band, the outer face of the second tape constituting said exposed face of the inner strip engageable with a wearer of the band.

7. An identification band as set forth in claim 6 wherein the second tape comprises cushioning material.

8. An identification band comprising first, second and third tapes, the second being sandwiched between the first and the third, the first being transparent, the third being of cushioning material, the first and second tapes being laminated together by pressure-sensitive adhesive with an insert therebetween having pre-printed identification indicia on one face thereof facing the first tape, the second tape extending the full length of the first tape, the second tape having pressure sensitive adhesive on its surface opposite the first tape and the second and third tapes being laminated together thereby, the third tape being formed to enable exposure of the pressure-sensitive adhesive on said surface of the second tape at one end of the band, and a release member covering said pressure-sensitive adhesive on said surface of the second tape at said one end of the band.

9. An identification band as set forth in claim 8 wherein the third tape terminates short of the second tape at said end of the band, the second tape thereby having a portion at said one end of the band extending beyond said third tape having the pressure-sensitive adhesive thereon covered by the release member.

10. An identification band as set forth in claim 8 wherein the third tape comprises cushioning material.

11. An identification band comprising a transparent tape having pressure-sensitive adhesive on one surface thereof constituting its inside surface, a second tape having an exposed face engageable with a wearer of the band, when the band is worn, and extending lengthwise of the transparent tape laminated to the transparent tape by the pressure-sensitive adhesive on said inside surface of the transparent tape, said second tape terminating short of one end of the band, the transparent tape thereby having a portion extending beyond said second tape, an insert between the transparent tape and the second tape, said insert having pre-printed identification indicia on one face thereof facing the transparent tape, and a release member covering the pressure-sensitive adhesive on the inside surface of said portion of the transparent tape extending beyond the second tape, whereby, upon removing the release member, the band may be formed into a bracelet with the transparent tape at said portion adhered to the transparent tape adjacent the other end of the band.

12. An identification band as set forth in claim 11 wherein the second tape comprises cushioning material.

13. An identification band comprising a transparent tape having pressure-sensitive adhesive on one surface thereof constituting its inside surface, a second tape extending the full length of the transparent tape and having a transverse line of perforations adjacent one end thereof defining an end portion of the second tape adjacent said one end of the band adapted to be torn away from the remainder of the second tape, said second tape being laminated to the transparent tape by the pressure-sensitive adhesive on the inside surface of the transparent tape from the other end of the band to the line of perforations, an insert between the transparent tape and the second tape located between said other end of the band and the line of perforations, said insert having pre-printed identification indicia on one face thereof facing the transparent tape, and release means between said end portion of the second tape and the transparent tape over the pressure-sensitive adhesive on the inside surface of the transparent tape at said one end of the band.

14. An identification band as set forth in claim 13 wherein the second tape comprises cushioning material.

15. An identification band as set forth in claim 13 wherein the release means comprises a coating of a release agent on the inside surface of the end portion of the second tape, the pressure-sensitive adhesive on the inside surface of the transparent tape at said one end of the band being exposed upon tearing said end portion away from the remainder of the second tape.

16. An identification band as set forth in claim 13 wherein the release means comprises a release member between the end portion of the second tape and the transparent tape, the pressure-sensitive adhesive on the inside surface of the transparent tape at said one end of the band being exposed upon tearing said end portion away from the remainder of the second tape and removing said release member.

17. A band for receiving an insert having preprinted identification indicia on one face thereof to form an identification bracelet, said band comprising a transparent tape having pressure-sensitive adhesive on one surface thereof constituting its inside surface, release means covering the pressure-sensitive adhesive on the inside surface of the transparent tape extending lengthwise of the transparent tape from one end thereof toward and terminating short of its other end, and a second tape extending lengthwise of the transparent tape from said other end of the transparent tape toward and terminating short of said one end of the transparent tape, said second tape being adhered to the transparent tape between said other end of the transparent tape and said release means, said release means being removable to expose the pressure-sensitive adhesive on the inside surface of the transparent tape for placement of an insert having identification indicia on one face thereof between the tapes with said one face of the insert facing the transparent tape and adherence of the tapes, with a portion of the transparent tape extending beyond the second tape at said one end and having the pressure-sensitive adhesive thereon on its inside surface for adherence to the transparent tape at its other end to form a bracelet.

18. A band as set forth in claim 17 wherein said release means comprises a first release member having its ends spaced inwardly from the ends of the band and a second release member extending between the said one end of the band and the adjacent end of the first release member.

19. A band as set forth in claim 17 wherein the second tape comprises cushioning material.

20. An identification band having a central indicia-receiving portion, a first end portion extending from one end of said central portion, and a second end portion extending from the other end of said central portion for enclasping the first end portion to form the band into a bracelet, the band comprising inner and outer strips laminated together by pressure-sensitive adhesive, the outer strip extending the full length of the band, the inner strip having an exposed face engageable with a wearer of the band, when the band is worn, and extending from the outer end of the first end portion to the inner end of the second end portion thereof, and covering one surface of the outer strip constituting its inside surface at said central and first end portions of the band, an insert between the strips at said central portion of the band having preprinted identification indicia on one face thereof facing the outer strip, the outer strip being transparent at least in part at said central portion and having pressure-sensitive adhesive on its inside surface at said second end portion of the band, and release means over the pressure-sensitive adhesive on the outer strip at said second end portion, whereby, upon removing the release means, the band may be formed into a bracelet with the outer strip at said second end portion adhered to the outer strip at said first end portion.

* * * * *